US007222951B2

(12) United States Patent
Hattori et al.

(10) Patent No.: US 7,222,951 B2
(45) Date of Patent: May 29, 2007

(54) INK CARTRIDGES

(75) Inventors: Shingo Hattori, Tsushima (JP); Tomohiro Kanbe, Nagoya (JP); Toyonori Sasaki, Anjo (JP)

(73) Assignee: Brother Kogyo Kabushiki kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/536,674

(22) Filed: Sep. 29, 2006

(65) Prior Publication Data

US 2007/0070152 A1 Mar. 29, 2007

Related U.S. Application Data

(60) Provisional application No. 60/826,254, filed on Sep. 20, 2006.

(30) Foreign Application Priority Data

| | | |
|---|---|---|
| Sep. 29, 2005 | (JP) | 2005-284646 |
| Nov. 28, 2005 | (JP) | 2005-342697 |
| Dec. 28, 2005 | (JP) | 2005-377987 |
| Mar. 9, 2006 | (JP) | 2006-064972 |
| Mar. 23, 2006 | (JP) | 2006-081806 |

(51) Int. Cl.
*B41J 2/175* (2006.01)

(52) U.S. Cl. ..... 347/86; 347/84; 347/85

(58) Field of Classification Search ..... 347/84, 347/85, 86

See application file for complete search history.

(56) References Cited

U.S. PATENT DOCUMENTS

| | | | | |
|---|---|---|---|---|
| 4,540,071 | A | 9/1985 | Schaub et al. | |
| 5,277,503 | A | 1/1994 | Nagao | |
| D397,143 | S * | 8/1998 | Kobayashi et al. | D18/56 |
| 6,592,212 | B1 * | 7/2003 | Kakutani | 347/86 |
| 2004/0061749 | A1 * | 4/2004 | Corby et al. | 347/86 |
| 2006/0007278 | A1 | 1/2006 | Holland et al. | |
| 2006/0181585 | A1 * | 8/2006 | Chen | 347/86 |

FOREIGN PATENT DOCUMENTS

JP 11058792 A 3/1999

* cited by examiner

*Primary Examiner*—Stephen Meier
*Assistant Examiner*—Laura E. Martin
(74) *Attorney, Agent, or Firm*—Baker Botts L.L.P.

(57) ABSTRACT

A method of manufacturing an ink cartridge system includes the steps of using a first mold to make a first case member a first ink cartridge, using a second mold to make a second case member of the first ink cartridge, using the first mold to make a first case member of a second ink cartridge, using a third mold to make a second case member of the second ink cartridge, using a fourth mold to make a first case member of a third ink cartridge, and using the third mold to make the second case member of the third ink cartridge. Moreover, a size of the first ink cartridge is not equal to a size of the second ink cartridge, the size of the first ink cartridge is not equal to a size of the third ink cartridge, and the size of the second ink cartridge is not equal to the size of the third ink cartridge.

8 Claims, 7 Drawing Sheets

INK CARTRIDGES

CROSS-REFERENCE TO RELATED APPLICATIONS

The present application claims priority from Japanese Patent Application No. BP-2005-284646, which was filed on Sep. 29, 2005, Japanese Patent Application No. BP-2005-342697, which was filed on Nov. 28, 2005, Japanese Patent Application No. BP-2005-377987, which was filed on Dec. 28, 2005, Japanese Patent Application No. BP-2006-064972, which was filed on Mar. 9, 2006, Japanese Patent Application No. BP-2006-081806, which was filed on Mar. 23, 2006, and U.S. Provisional Patent Application No. 60/826,254, which was filed on Sep. 20, 2006, the disclosures of which are incorporated by reference in their entirety.

BACKGROUND OF THE INVENTION

1. Field of the Invention

The present invention relates generally to ink cartridges. In particular, the present invention is directed towards ink cartridges which may be used in combination with ink jet printers.

2. Description of Related Art

Ink cartridges which are configured to be used in combination with ink jet printers are known in the art.

SUMMARY OF THE INVENTION

According to an embodiment of the present invention, an ink cartridge system comprises at least three ink cartridges comprising a first ink cartridge, a second ink cartridge, and a third ink cartridge. A size of the first ink cartridge is not equal to a size of the second ink cartridge, the size of the first ink cartridge is not equal to a size of the third ink cartridge, and the size of the second ink cartridge is not equal to the size of the third ink cartridge. Each of the at least three ink cartridges comprises a case comprising a first case member, and a second case member connected to the first case member. Each of the first case member and the second case member comprises a first wall, and at least one second wall. Moreover, an area of the first wall is greater than an area of the at least one second wall, and the at least one second wall is perpendicular to the first wall. In addition, an area of the at least one second wall of the first case member of the first ink cartridge is the same as an area of the at least one second wall of the first case member of the second ink cartridge, and an area of the at least one second wall of the second case member of the second ink cartridge is the same as an area of the at least one second wall of the second case member of the third ink cartridge.

According to another embodiment of the present invention, a method of manufacturing an ink cartridge system comprises the steps of using a first mold to make a first case member a first ink cartridge, using a second mold to make a second case member of the first ink cartridge, using the first mold to make a first case member of a second ink cartridge, using a third mold to make a second case member of the second ink cartridge, using a fourth mold to make a first case member of a third ink cartridge, and using the third mold to make the second case member of the third ink cartridge. Moreover, a size of the first ink cartridge is not equal to a size of the second ink cartridge, the size of the first ink cartridge is not equal to a size of the third ink cartridge, and the size of the second ink cartridge is not equal to the size of the third ink cartridge.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention and their features and technical advantages may be understood by referring to FIGS. 1-5, like numerals being used for like corresponding portions in the various drawings.

Figure 1:
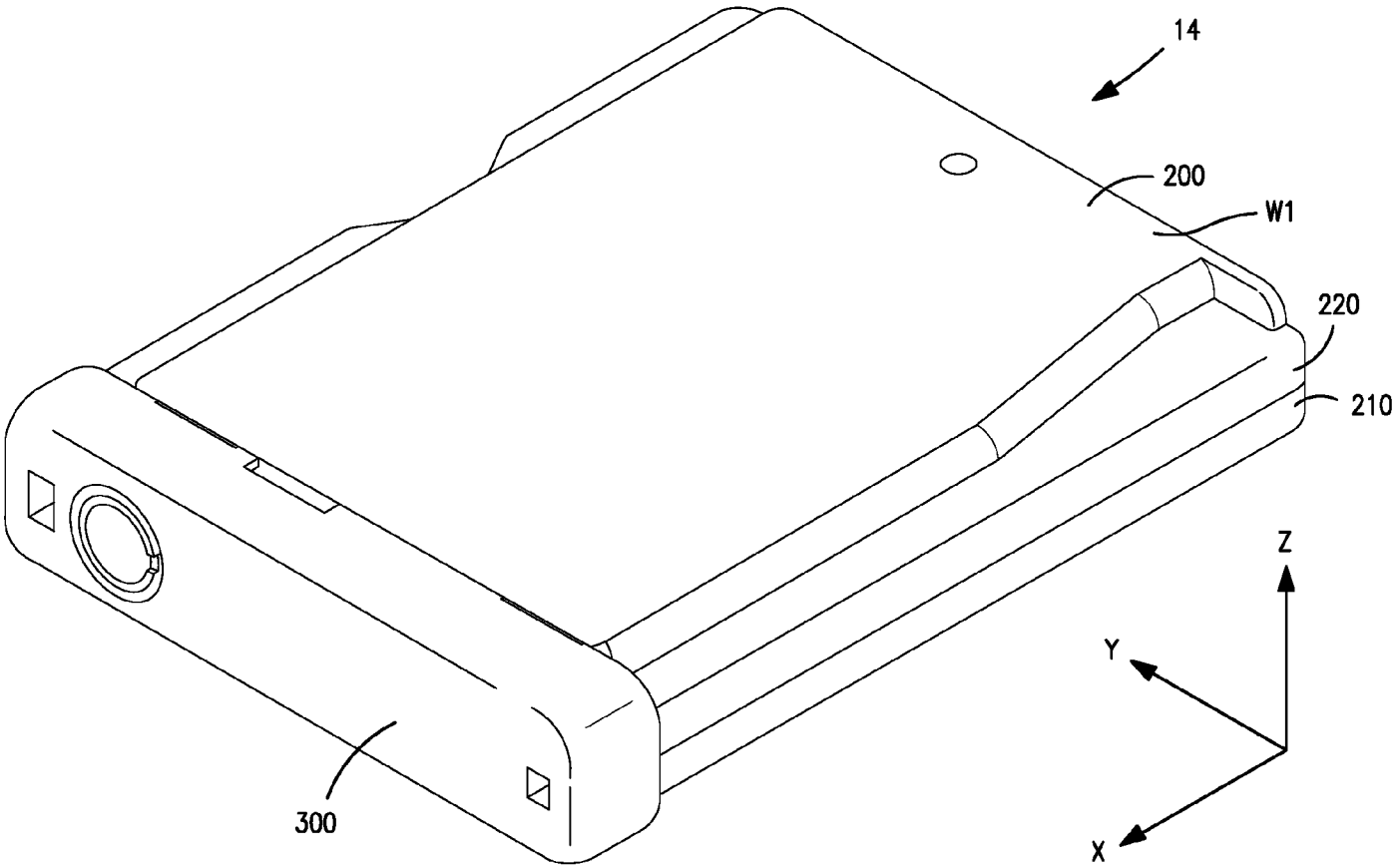
FIG. 1 is a perspective view of an ink cartridge, according to an embodiment of the present invention.
Figure 2:
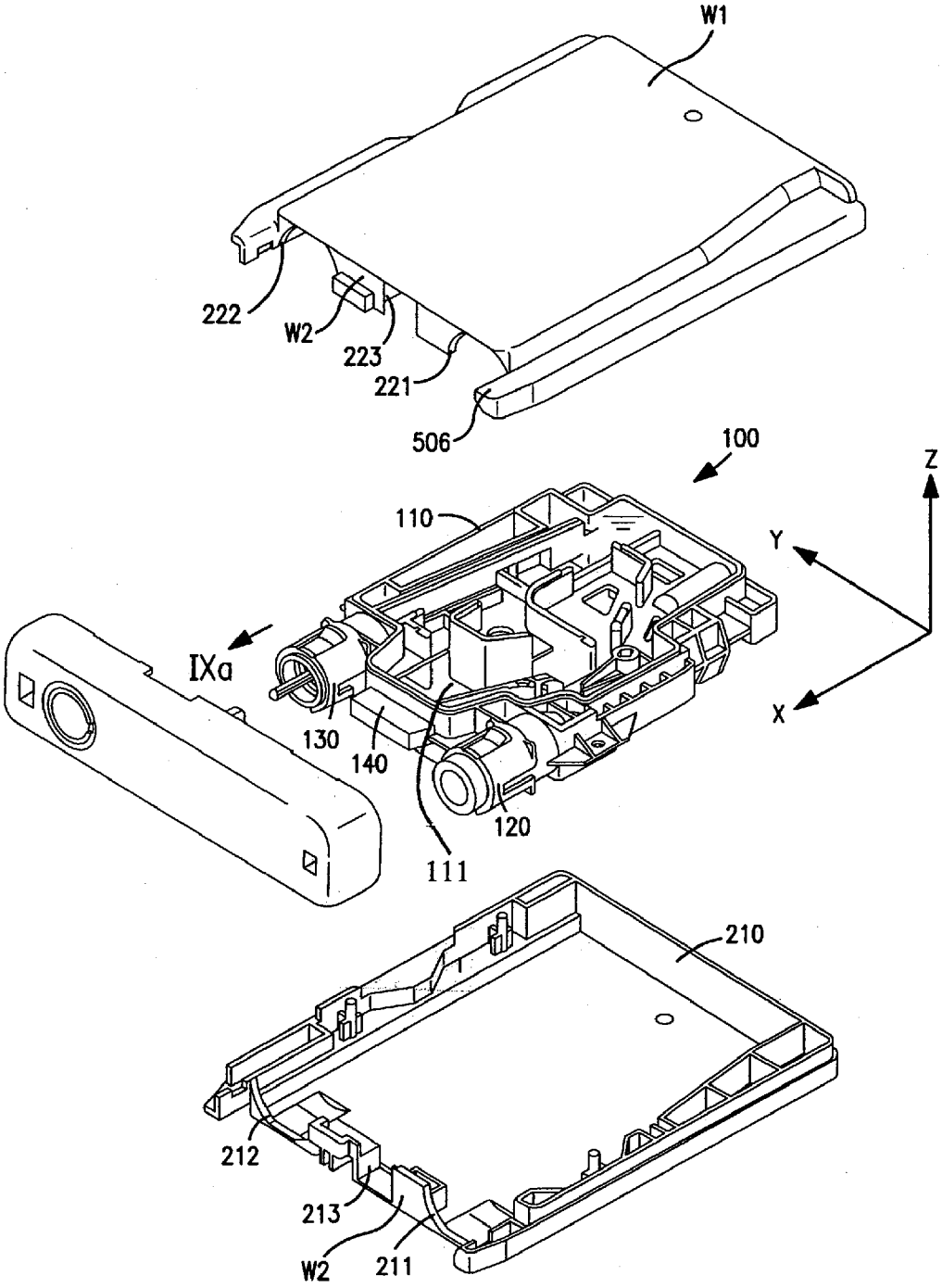
FIG. 2 is an expanded, perspective view showing an interior of the ink cartridge of FIG. 1, according to an embodiment of the present invention.
Figure 3:
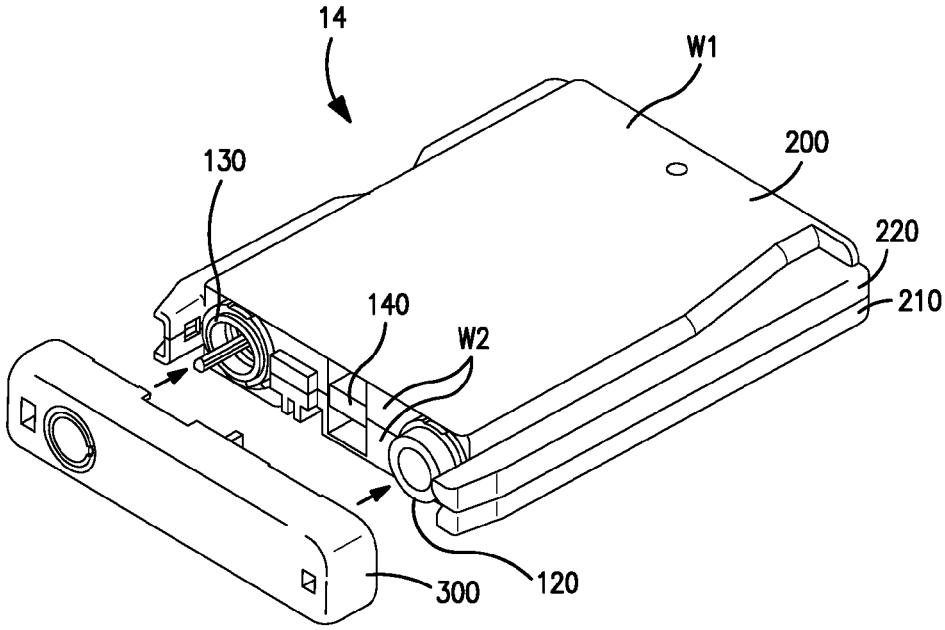
FIG. 3 is a perspective view of an ink cartridge showing a process for attaching a protective cap to the ink cartridge, according to an embodiment of the present invention.

Referring to FIGS. 1-3, an ink cartridge 14 may comprise an ink reservoir element 100 which is configured to store ink, a case 200 which may substantially cover the entire body of ink reservoir element 100, and a protector 300 which may be attached to case 200 and protects ink reservoir element 100 when ink cartridge 14 is in transit. Case 200 may have a substantially rectangular, parallelepiped shape. In an embodiment of the present invention, ink reservoir element 100, case 200, protector 300, and all of the members contained in ink cartridge 14 may comprise non-metal materials, e.g., may comprise resin materials, such that they may be burned at the time of disposal. For example, nylon, polyester, or polypropylene may be used as resin materials.

Ink reservoir element 100 may comprise a frame portion 110 which forms an ink chamber 111 which is configured to store ink, an ink supply portion 120 which is configured to supply ink stored in ink chamber 111 to a multifunctional device (not shown), such as a printer, and an ambient air intake portion 130 which is configured to introduce ambient air into frame portion 110. Ink reservoir element 100 also may comprise a translucent portion 140 which may allow for the detection of the amount of ink stored in ink chamber 111.

Case 200 may comprise a first case member 210 and a second case member 220 which are configured to sandwich ink reservoir element 100. First case member 210 may be a member which covers the bottom side surface of ink reservoir element 100, and second case element 220 may be a member which covers the top side surface of ink reservoir element 100. First and second case members 210 and 220 may comprise at least one resin material, and may be manufactured using injection molding. First and second case members 210 and 220 each may comprise a first wall We and a second wall We which is substantially perpendicular to first wall We. The area of first wall We may be greater than the surface area of second wall We.

A pair of case cutout portions 211 and 212 may be provided through second wall We of first case member 210 for exposing ink supply portion 120 and ambient air intake portion 130, respectively, to the outside of case 200. Case cutout portions 211 and 212 may be substantially semicircular. A case cutout portion 213 also may be provided through second wall We of first case member 210 between case cutout portion 211 and case cutout portion 212, and case cutout portion 213 may be for receiving a sensor (not shown) of the multifunctional device at a position where the sensor sandwiches translucent portion 140. For example, case cutout portion 213 may have a substantially square or rectangular shape. Similarly, second case member 220 may comprise case cutout portions 221, 222, 223, which may correspond to case cutout portions 211, 212, and 213, respectively. When first case member 210 is connected to second case member 220 to form case 200, case cutout portions 211 and 221 may form a first opening, case cutout portions 212 and 222 may form a second opening, and case cutout portions 213 and 223 may form a third opening. Moreover, when ink reservoir element 100 is positioned within case 200, ink supply portion 120 may protrude from the first opening, ambient air intake portion 130 may protrude from the second opening, and a portion of translucent portion 140 may be aligned substantially flush with the third opening.

Figure 4:
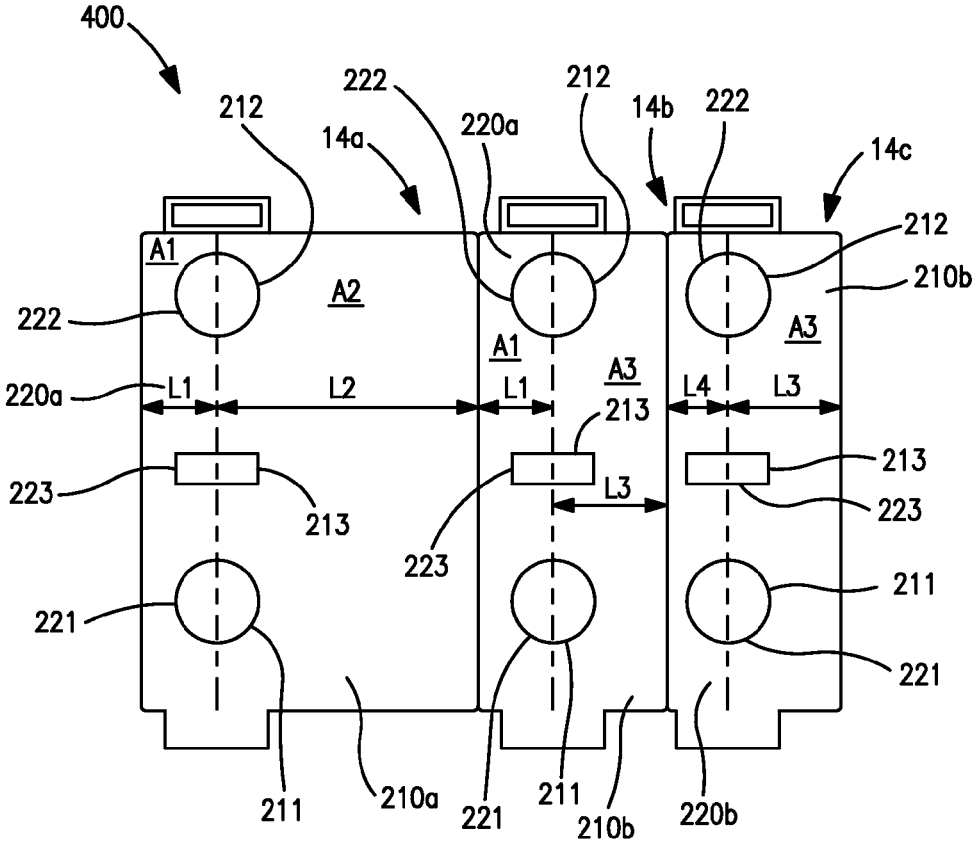
FIG. 4 is a front view of a plurality of different sized ink cartridges of an ink cartridge system, according to an embodiment of the present invention.

Referring to FIG. 4, in an embodiment of the present invention, an ink cartridge system 400 may comprise a plurality of separate ink cartridges 14, e.g., at least three separate ink cartridges 14. For example, ink cartridge system 400 may comprise a first ink cartridge 14*a*, a second ink cartridge 14*b*, and a third ink cartridge 14*c*. First ink cartridge 14*a* may correspond to a large capacity black ink cartridge, second ink cartridge 14*b* may correspond to a small capacity black ink cartridge, and third ink cartridge 14*c* may correspond to a color ink cartridge, i.e., a non-black ink cartridge. First ink cartridge 14*a* may comprise a first case member 210*a* having a length L2 and an area A2 and a second case member 220*a* having a length L1 and an area A1, second ink cartridge 14*b* may comprise a first case member 210*b* having a length L3 and an area A3 and second ink case member 220*a*, and third ink cartridge 14*c* may comprise first case member 210*b* and a second case member 220*b* having a length L4 and an area A4. As such, the second case member of first ink cartridge 14*a* may have substantially the same length and area as the second case member of second ink cartridge 14*b*, and the first case member of second ink cartridge 14*b* may have the same length and area as the first case member of third ink cartridge 14*c*. Moreover, the first case member of first ink cartridge 14*a* may be longer than the second case member of third ink cartridge 14*c*, e.g., may be about twice as long, and may have a larger area than the second case member of third ink cartridge 14, such that the size of first ink cartridge 14*a* may be greater than the size of second ink cartridge 14*b*, and the size of second ink cartridge 14*b* may be greater than the size of third ink cartridge 14*c*.

In an embodiment of the present invention, a case member having the same dimensions may be used for the second case member of first ink cartridge 14*a* and the second case member of second ink cartridge 14*b*, such that the same mold may be used to manufacture the second case member of first ink cartridge 14*a* and second ink cartridge 14*b*. Similarly, the same case member may be used for the first case member of second ink cartridge 14*b* and the first case member of third ink cartridge 14*c*, such that the same mold may be used to manufacture the first case member of second ink cartridge 14*b* and third ink cartridge 14*c*. As such, when ink cartridge system 400 comprises three ink cartridges 14, the case members of case 200 may be manufactured using four different case member molds instead of six different case member molds, which reduces manufacturing costs and manufacturing time.

Figure 5:
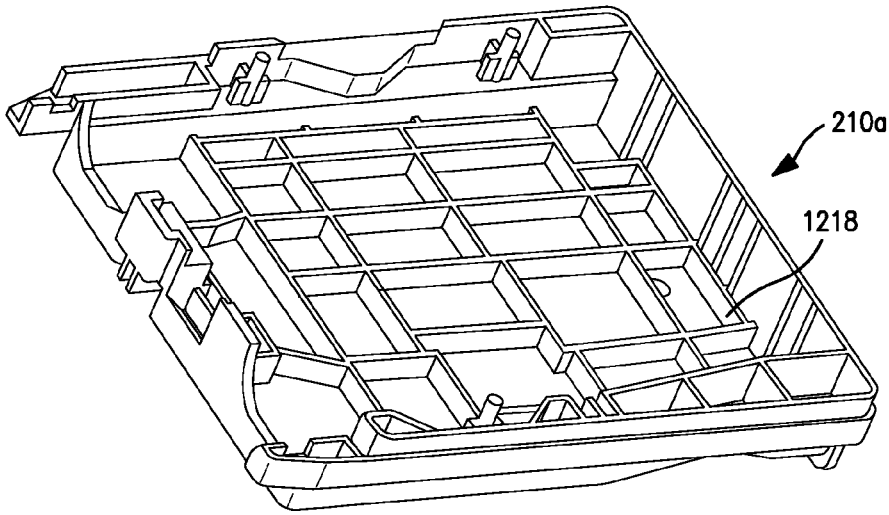
FIG. 5 is a perspective view of an interior of a case member, according to an embodiment of the present invention.

Referring to FIG. 5, a rib 1218 may be provided on substantially the entire inside surface of first case member 210*a*, and rib 1218 protrudes in the Z-direction towards the side of ink reservoir element 100. Because rib 1218 may be provided, the space provided between ink reservoir element 100 and first case member 210*a* may be filled. It therefore may be possible to maintain the strength of case 200 against pressure from the outside. For example, the length of rib 1218 in the Z-direction may be about equal to a difference between the length of the first case member of first ink cartridge 14*a* and the length of the first case member of third ink cartridge 14*c*.

Figure 6:
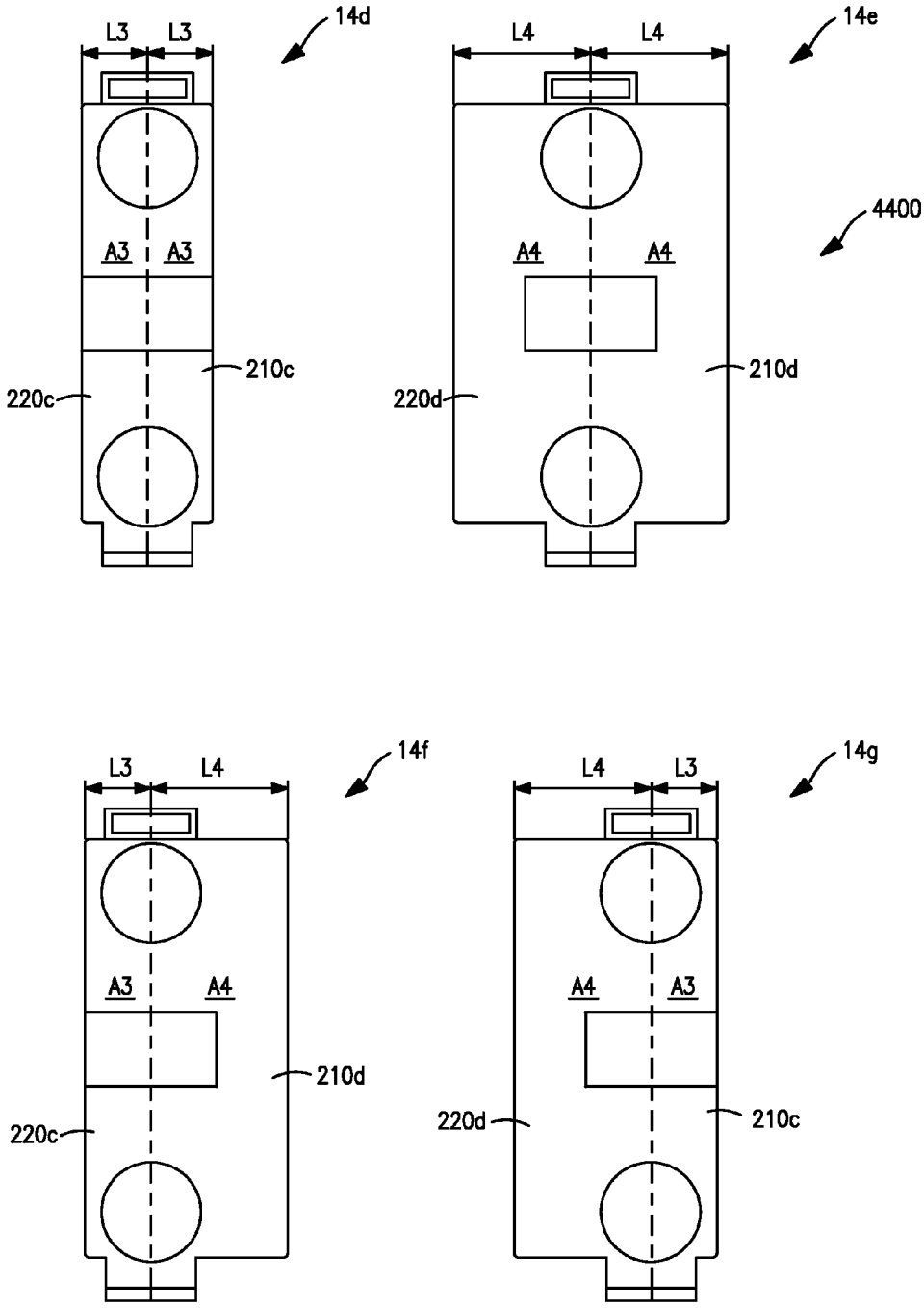
FIG. 6 is a front view of a plurality of different sized ink cartridges of an ink cartridge system, according to another embodiment of the present invention.

Referring to FIG. 6, in another embodiment of the present invention, an ink cartridge system 4400 may comprise a plurality of separate ink cartridges 14. For example, ink cartridge system 4400 may comprise a first ink cartridge 14*e*, a second ink cartridge 14*f*, a third ink cartridge 14*d* and a fourth ink cartridge 14*g*. First ink cartridge 14*e* may comprise a first case member 210*d* having a length L4 and an area A4 and a second case member 220*d* having a length L4 and an area A4. Third ink cartridge 14*d* may comprise a first case member 210*c* having a length Le and an area Ea and a second case member 220*c* having a length L3 and an area A3. Second ink cartridge 14*f* may comprise first case member 210*d* and second ink case member 220*c*. Fourth ink cartridge 14*g* may comprise first case member 210*c* and second case member 220*d*. L4 may be about twice as long as L3, and A4 may be about twice as large as A3. As such, first case member of second ink cartridge 14*f* may have substantially the same length and area as the first case member of first ink cartridge 14*e*, and second case member of second ink cartridge 14*f* may have substantially the same length and area as the second case member of third ink cartridge 14*d*. Similarly, first case member of fourth ink cartridge 14*g* may have substantially the same length and area as the first case member of third ink cartridge 14*d*, and second case member of fourth ink cartridge 14*g* may have substantially the same length and area as the second case member of first ink cartridge 14*e*. The size of third ink cartridge 14*d* may be less than the size of second ink cartridge 14*f* and the size of the forth ink cartridge 14*g*. The size of second ink cartridge 14*f* and the size of the forth ink cartridge 14*g* may be less than the size of the first ink cartridge 14*e*.

In an embodiment of the present invention, when ink cartridge system 4400 comprises four ink cartridges 14, the case members of case 200 may be manufactured using four different case member molds instead of eight different case member molds, which reduces manufacturing costs and manufacturing time.

Figure 7:
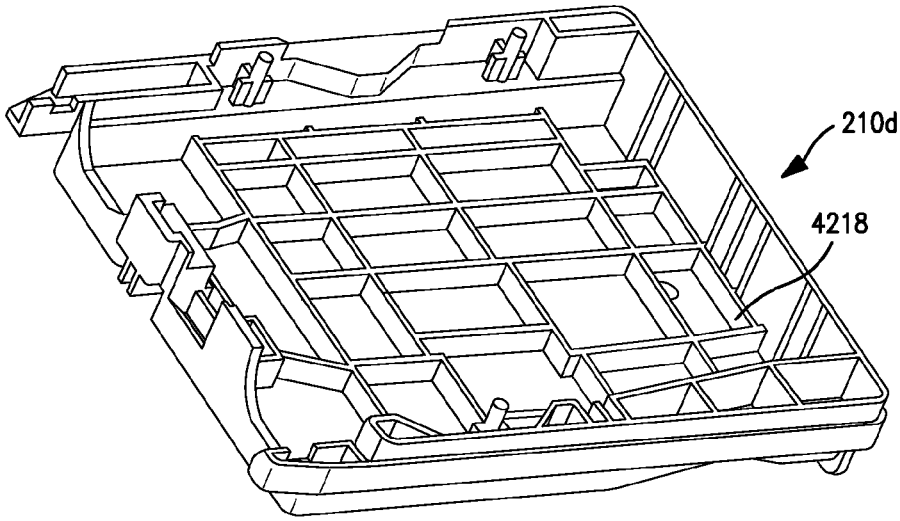
FIG. 7 is a perspective view of an interior of a case member, according to another embodiment of the present invention.

Referring to FIG. 7, a rib 4218 may be provided on substantially the entire inside surface of first case member 210*d*, and rib 4218 protrudes in the Z-direction towards the side of ink reservoir element 100. Because rib 4218 may be provided, the space provided between ink reservoir element 100 and first case member 210*d* may be filled. The length of rib 4218 in the Z-direction may be about equal to a difference between L3 and L4. Therefore, same size of ink reservoir element 100 may fit into second ink cartridge 14*f* and third ink cartridge 14*d* and thereby two ink cartridges, which are different in outer shapes, but has same ink reservoir element therein, may be provided.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge system, comprising:

at least three ink cartridges, comprising:

a first ink cartridge;

a second ink cartridge; and a third ink cartridge, wherein a size of the first ink cartridge is not equal to a size of the second ink cartridge, the size of the first ink cartridge is not equal to a size of the third ink cartridge, and the size of the second ink cartridge is not equal to the size of the third ink cartridge, wherein each of the at least three ink cartridges comprises:

a case, comprising:

a first case member; and a second case member connected to the first case member, wherein each of the first case member and the second case member comprises:

a first wall; and at least one second wall, wherein an area of the first wall is greater than an area of the at least one second wall, and the at least one second wall is perpendicular to the first wall, wherein an area of the at least one second wall of the first case member of the first ink cartridge is the same as an area of the at least one second wall of the first case member of the second ink cartridge, and an area of the at least one second wall of the second case member of the second ink cartridge is the same as an area of the at least one second wall of the second case member of the third ink cartridge.

2. The ink cartridge system of claim 1, wherein an area of the first case member of the first ink cartridge is the same as an area of the first case member of the second ink cartridge, and an area of the second case member of the second ink cartridge is the same as the area of the second case member of the third ink cartridge.

3. The ink cartridge of claim 1, wherein the size of the third ink cartridge is less than the size of the second ink cartridge, and the size of the second ink cartridge is less than the size of the first ink cartridge.

4. The ink cartridge of claim 1, wherein an area of the first wall of the first case member of the first ink cartridge is the same as an area of the first wall of the first case member of the second ink cartridge, and an area of the first wall of the second case member of the second ink cartridge is the same as the area of the first wall of the second case member of the third ink cartridge.

5. The ink cartridge of claim 3, wherein a length of the at least one second wall is perpendicular to the first wall, a length of the at least one second wall of the first case member of the first ink cartridge is equal to a length of the at least one second wall of the second case member of the first ink cartridge, and a length of the at least one second wall of the first case member of the third ink cartridge is equal to a length of the at least one second wall of the second case member of the third ink cartridge.

6. The ink cartridge of claim 5, wherein the length of the at least one second wall of the first case member of the first ink cartridge is about two times greater than the length of the at least one second wall of the first case member of the third ink cartridge.

7. The ink cartridge of claim 5, wherein the first case member of the first ink cartridge comprises a rib extending from and perpendicular to the first wall of the first case member of the first cartridge in a predetermined direction, wherein a length of the rib in the predetermined direction is about equal to a difference between the length of the at least one second wall of the first case member of the first ink cartridge and the length of the at least one second wall of the first case member of the third ink cartridge.

8. The ink cartridge of claim 1, wherein the case has an opening formed therethrough, and the at least one second wall of the first case member has a first opening portion formed therethrough and the at least one second wall of the second case member has a second opening portion formed therethrough, wherein the opening of the case comprises the first opening portion and the second opening portion.

* * * * *